United States Patent [19]

Buchholz et al.

[11] 4,279,687

[45] Jul. 21, 1981

[54] LABELING STATION WITH GLUEING MEANS FOR BOTTLES OR THE LIKE

[75] Inventors: Rainer Buchholz; Rudolf Zodrow, both of Dusseldorf; Heinz J. Rosenberg, Neuss, all of Fed. Rep. of Germany

[73] Assignee: Jagenberg-Werke AG, Dusseldorf, Fed. Rep. of Germany

[21] Appl. No.: 72,378

[22] Filed: Sep. 4, 1979

[30] Foreign Application Priority Data

Sep. 1, 1978 [DE] Fed. Rep. of Germany ..... 2838158

[51] Int. Cl.[3] ..... B65C 9/10; B65C 9/16

[52] U.S. Cl. ..... 156/568; 118/677; 118/231; 118/261; 156/571; 156/578; 156/DIG. 29; 156/DIG. 32; 271/33

[58] Field of Search ..... 156/357, 568, 567, 571, 156/578, DIG. 29, DIG. 32; 118/677, 678, 680, 231, 220, 261; 271/33

[56] References Cited

U.S. PATENT DOCUMENTS

| | | | |
|---|---|---|---|
| 3,070,066 | 12/1962 | Faeber | 118/261 |
| 3,969,742 | 7/1976 | McCabe | 118/261 |
| 4,226,660 | 10/1980 | Carter | 156/357 |

FOREIGN PATENT DOCUMENTS

| | | | |
|---|---|---|---|
| 2632332 | 1/1978 | Fed. Rep. of Germany | 156/567 |

*Primary Examiner*—Michael G. Wityshyn

*Attorney, Agent, or Firm*—Sprung, Felfe, Horn, Lynch & Kramer

[57] ABSTRACT

In a labeling station for bottles or the like, a glue scraper is mounted for swinging movement so that it is positionable ahead of a glue roll doctor blade so that any glue applied to the glue roll from a glue nozzle will be scraped off when there is a gap in the delivery of bottles to the labeling station.

14 Claims, 6 Drawing Figures

FIG.1
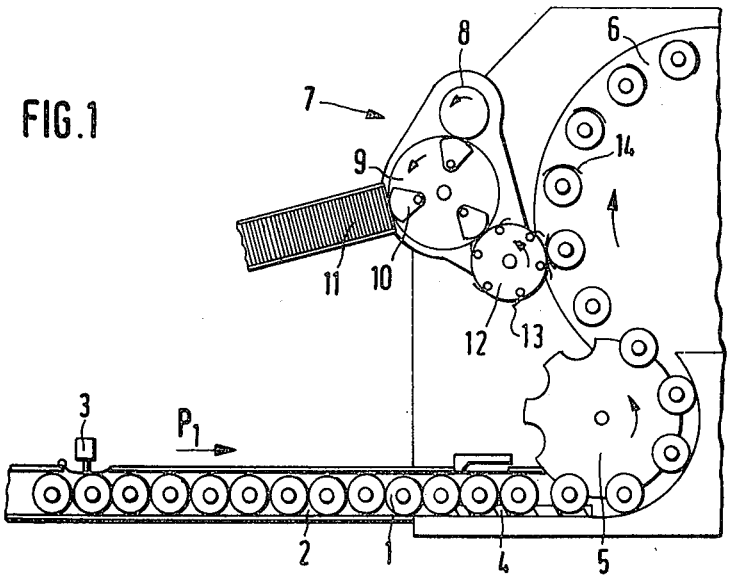
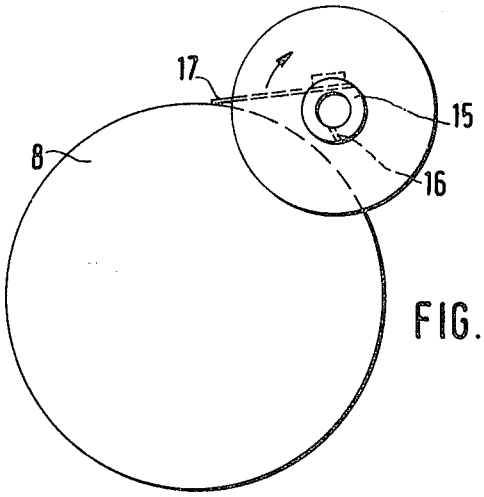
FIG.3

27
25
23
21
20
19
22
18
26
28
29
15
16
21
20

LABELING STATION WITH GLUEING MEANS FOR BOTTLES OR THE LIKE

The invention relates to a labeling station for bottles or the like comprising at least one glue segment which is mounted on a revolving carrier and is adapted to rotate or swing about its own axis, and which after having its pickup surface coated with glue by a rotating glue roll picks up from a label magazine, and in particular from a stack of labels, the foremost label and transfers it to a labeling means, in particular a rotating gripper cylinder, which then affixes the label by its glue-coated side to a bottle moving past it, the thickness of the layer of glue applied to the surface of the glue roll by an applicator means, in particular a nozzle, being adjustable by means of a doctor blade whose spacing from the glue-roll surface can be varied.

A common cause of trouble in labeling stations is that when the bottle feed is interrupted or there are gaps in the row of bottles, the glue segments continue to pick up labels from the label magazine, which, however, cannot be applied because of the missing bottles. These unneeded labels deposit somewhere in the labeling station, thereby impeding the smooth handling of further labels as the continuous feed of bottles is resumed. To overcome these difficulties, it is known to stop the dispensing of labels from the label magazine when no bottles are being fed or when there is a gap in the bottle feed. While this eliminates the major cause of trouble in the handling of labels, a further cause of trouble persists, and that is that glue continues to be supplied to the glue roll, and hence to the glue segment, when a break or gap occurs in the bottle feed. Since no glue is being picked up from the glue segments when the delivery of labels has been stopped, the surplus glue results in a splashing of glue from the segments, and thus in a fouling of the labeling station.

To overcome these difficulties as well, it is known to reduce the thickness of the glue layer by setting the doctor blade closer to the glue-roll surface so that while glue continues to be supplied to the glue roll, the layer of glue is no longer of such thickness that glue might be flung off the glue-roll surface. (German patent application DOS No. 2,632,332.)

In this prior-art labeling station, it has been deemed necessary to keep the glue roll, and hence the glueing segments, wetted by maintaining the glue feed. Scraping them completely dry by means of the glue scraper would have entailed the risk of the glue-roll surface running hot. Because of the necessary provision for changeover from the idling position to the operating position and vice versa, some play will develop in the course of time no matter how precise the initial adjustment may have been, with the result that precise adjustment of the thickness of the glue layer for operation and for idling can no longer be secured. This unreliability of adjustment poses the danger that in the operating position too much or too little glue may be applied, and that in the idling position too much glue may be applied or the glue scraper may bear on the glue roll with too much pressure so that the glue roll with its sensitive surface will run hot.

The invention has as its object to provide a labeling station of the type outlined above in which the application of glue to the surface of the glue roll is completely stopped and the glue-roll surface and the glueing segment or segments are deglued.

In accordance with the invention, this object is accomplished in that there is disposed ahead of the doctor blade, in the direction of rotation of the glue roll, a glue scraper which can be set so close to the glue-roll surface as to make contact with it, and that the applicator means with its jet directed toward the glue-roll surface is adapted to be swung away therefrom.

In the invention, the initial spacing of the doctor blade from the glue-roll surface is maintained also in idling. This provides assurance that any play in the operation of the other moving parts involved in the application of glue that would affect the thickness of the glue layer will have no effect thereon. Since the function of the glue scraper is merely to scrape the glue-roll surface dry in idling, the scraper can be designed in such a way that the glue-roll surface will not run hot. Of course, the scraper need only be engaged for the length of time required to remove the glue. Since the pickup elements continue to roll along the glue roll, they are stripped of glue directly by the glue roll from which the glue has been removed. While in the labeling stations known up to now the glue feed has been either stopped completely or throttled, or then fully maintained, in the invention the glue feed is maintained but no glue is applied to the glue roll, the glue jet being deflected. However, the application of glue to the glue roll can be rapidly resumed simply by swinging back the glue jet.

The application of glue to the glue roll can be resumed particularly quickly when the applicator means is a slot nozzle. The slot nozzle may, in particular, be constructed as an elongated slot in a tube. With such a nozzle, glue can be applied to the glue roll all at once over its entire length.

In accordance with a preferred embodiment, the glue scraper, which may, in particular, bear tangentially on the glue-roll surface, is initially tensioned. The glue scraper may be made of a material having the resilience of a spring.

Since both the applicator means and the glue scraper must be displaced for idling, it is advisable to provide for them a common actuating drive. A preferred actuating drive consists of a cylinder-piston arrangement to whose piston, coupled to the stationary cylinder housing through a steep-pitch thread, the applicator means is nonrotatably joined.

Particularly in conjunction with the glue scraper which bears on the glue-roll surface with initial tension, a glue roll has proved advantageous which has a composite structure consisting of a wear-resistant cylinder and radially resilient support members supporting said cylinder. The roll cylinder essentially consists of a rigid, shape-retaining material such as sheet steel. The support members may be made of a material having the resilience of rubber and may be mounted on a sleeve which is free to rotate on the glue-roll shaft. The support members are preferably rings and axially spaced from one another. In such a glue roll, even hot spots due to overheating would not have a particularly deleterious effect since the glue-roll cylinder may be made of a heat-resistant material. Even though the cylinder is made of a shape-retaining material such as sheet steel, it will yield in rolling along the glueing segments because of its resilient support.

The invention will now be explained in greater detail with reference to a drawing illustrating an embodiment, wherein:

FIG. 1 is a diagrammatic top plan view of a labeling machine with a labeling station;

FIG. 3 is a top plan view of a portion of the labeling station of FIG. 2, namely, the glueing means;

Figure 2:
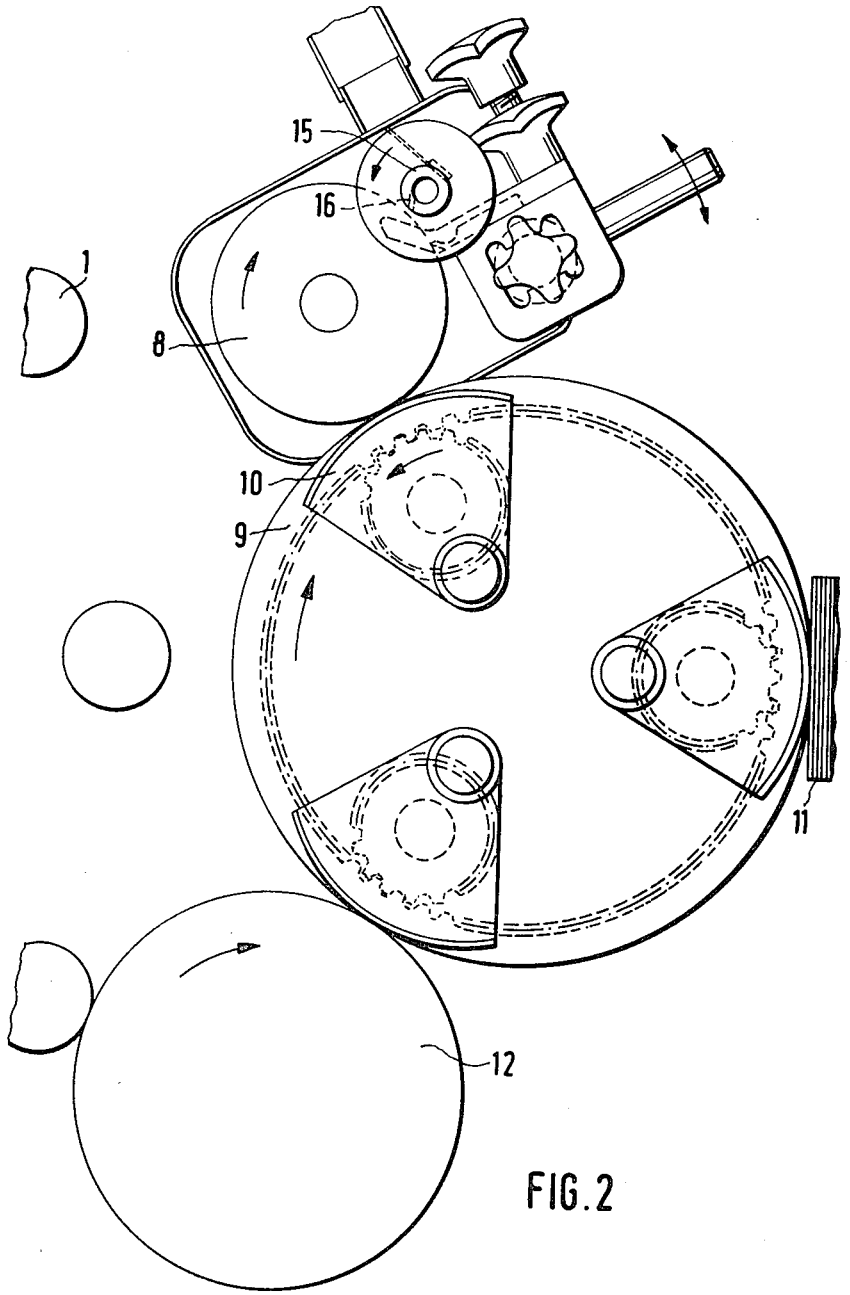
FIG. 2 is a top plan view on an enlarged scale of the labeling station of the labeling machine of FIG. 1.

As shown in FIG. 1, the bottles 1 to be labeled are carried in a row, upright, on a conveyor belt, and more particularly an apron conveyor 2, in the direction indicated by the arrow $P_1$. Disposed along the conveying path is a sensor 3 which is forced back by the bottles 1 but moves into the path of the bottles when the bottle feed is interrupted or bottles are missing in the feed line and delivers a control signal for various elements to be described further on. The traveling bottles 1 then reach a screw conveyor 4 which spaces them and feeds them to a feed spider 5. From there the bottles pass onto a turntable 6 where they are held by means which are not shown and are rotated or swung about their own axes in order that the labels affixed to the bottles may be fully applied to the bottles as they move past brushes which are not shown.

Disposed along the circular path of the bottles 1 carried by the turntable 6 is a labeling station 7 which consists of a glueing means comprising a rotating glue roll 8, a revolving carrier 9 comprising a plurality of glueing segments 10, a label magazine 11 in the form of a stack of labels which is stationary at the periphery of the carrier 9, and a rotating gripper cylinder 12. The glue roll has a hollow shaft 33, secured against rotation, through which a drive shaft 34 coupled to the central drive extends. Rotatably mounted on the hollow shaft 33 by means of bearing 35 and 36 is a sleeve 37 which through a plate 38 is joined to the drive shaft 34, secured against rotation relative thereto. The cylindrical sleeve 37 carries on its outside a plurality of support members 39 which are constructed as rings made of a material having the resilience of rubber, are axially spaced from one another, and support a shape-retaining roll cylinder 40 made of sheet steel or of a hard plastics material but in any case of a wear-resistant material. In conjunction with the support members 39 which support it, the roll cylinder 40 imparts to the glue roll resilience in the radial direction and provides a high degree of frictional wear resistance. In the event that as a result of a malfunction labels should build up on the glue-coated pickup surface of the glueing segments 10, or pile up on the glue roll 8 as far as the scraper 17, the roll 8 will not be destroyed by excessive pressure in the area of the glueing segments 10 or by heat due to friction or abrasion.

The principle of operation of the labeling machine described so far is as follows:

Glue is applied in a thin layer to the glue roll 8. The glueing segments 10 which roll along the glue roll 8 pick up glue from the surface of that roll and then roll along the front of the stack of labels 11. In so doing, they pick up the foremost label from the stack 11 and transfer it to the gripper cylinder 12 which is provided with a plurality of gripping members 13 and affixes a label 14 to each bottle. Elements which are not shown then rotate the bottle and move it past brushes which are not shown and which apply the label fully to the bottle.

The sensor 3 which is responsive to gaps in the row of bottles determines the length of the gap by means of a timing element. When the gap is short, it merely causes the stack of labels 11 to be retracted, by means which are not shown, so that no further labels can be picked up from it. In the case of a longer gap, there occurs, in addition, an interruption of the glue feed to the glue roll, brought about by means described below. However, the machine continues in operation.

Figure 5:
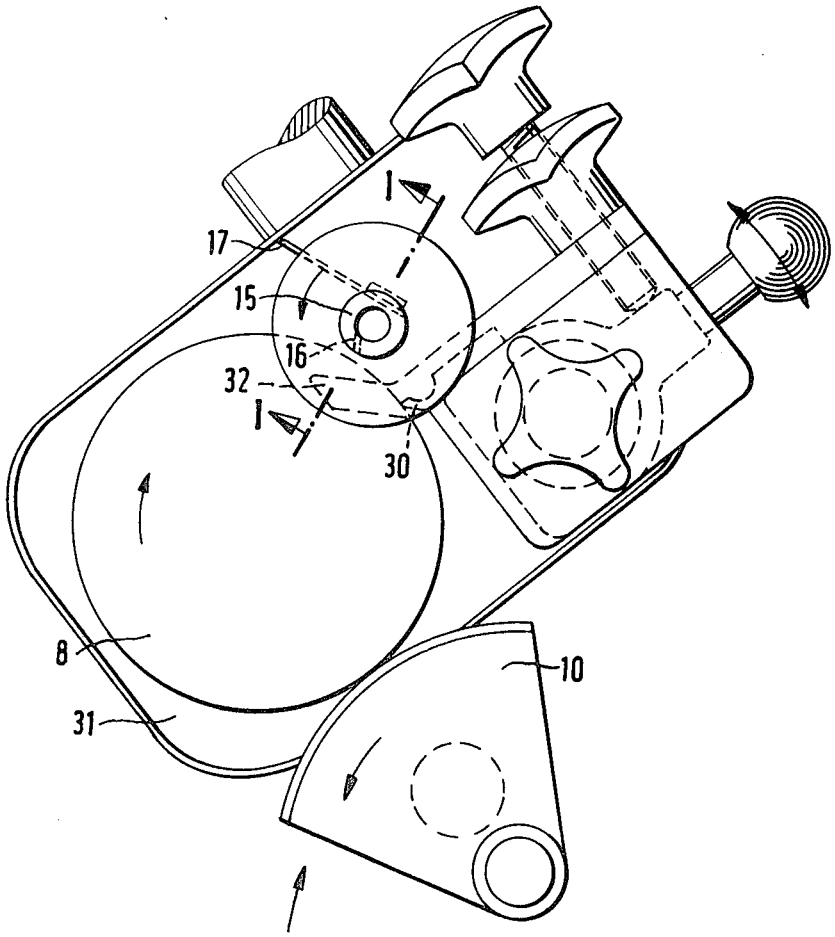
FIG. 5 shows the glue roll with applicator means and glue scraper according to FIG. 3 in a position differing from the latter.
Figure 6:
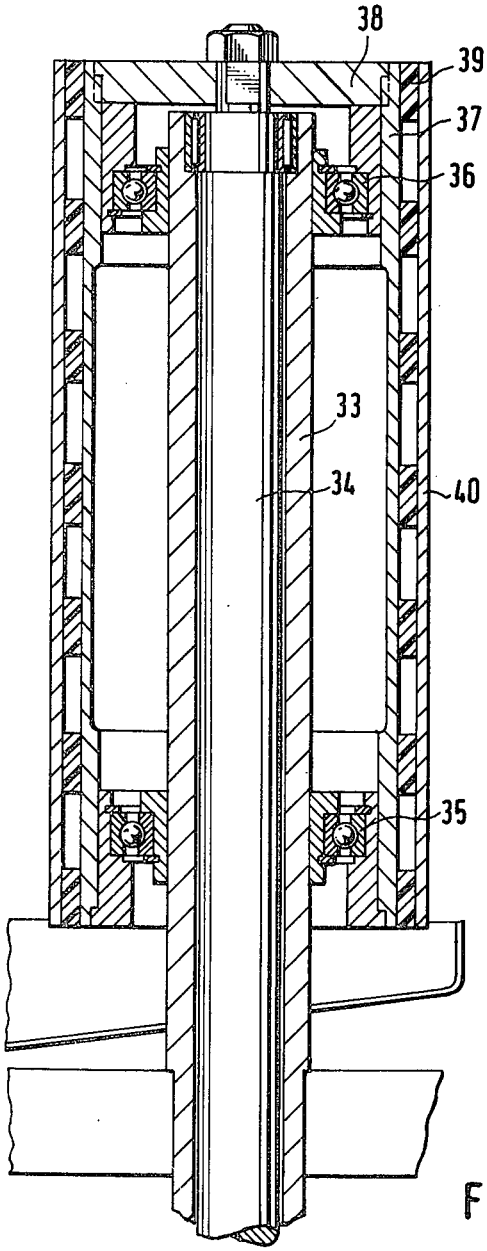
FIG. 6 is an axial section through a glue roll of composite structure.

The glueing means with the glue roll 8 comprises as applicator means for the glue a tube 15 extending parallel to the axis of the glue roll 8 and having an elongated slot 16. The latter is disposed, not radially but slightly obliquely to provide a better break-away edge for the exiting glue. Fastened to the tube 15 is a glue scraper 17 in the form of a spring leaf. The angular relationship between the direction of the jet from the slot 16 and the glue scraper 17 is such that when the jet issuing from the slot 16 is directed at the glue-roll surface, the glue scraper 17 is swung away from the glue-roll surface, as shown in FIG. 5, whereas when the slot 16 points past the glue-roll surface, the glue scraper bears approximately tangentially on the glue-roll surface. (FIG. 3.)

Figures 4, 4A, 4B:
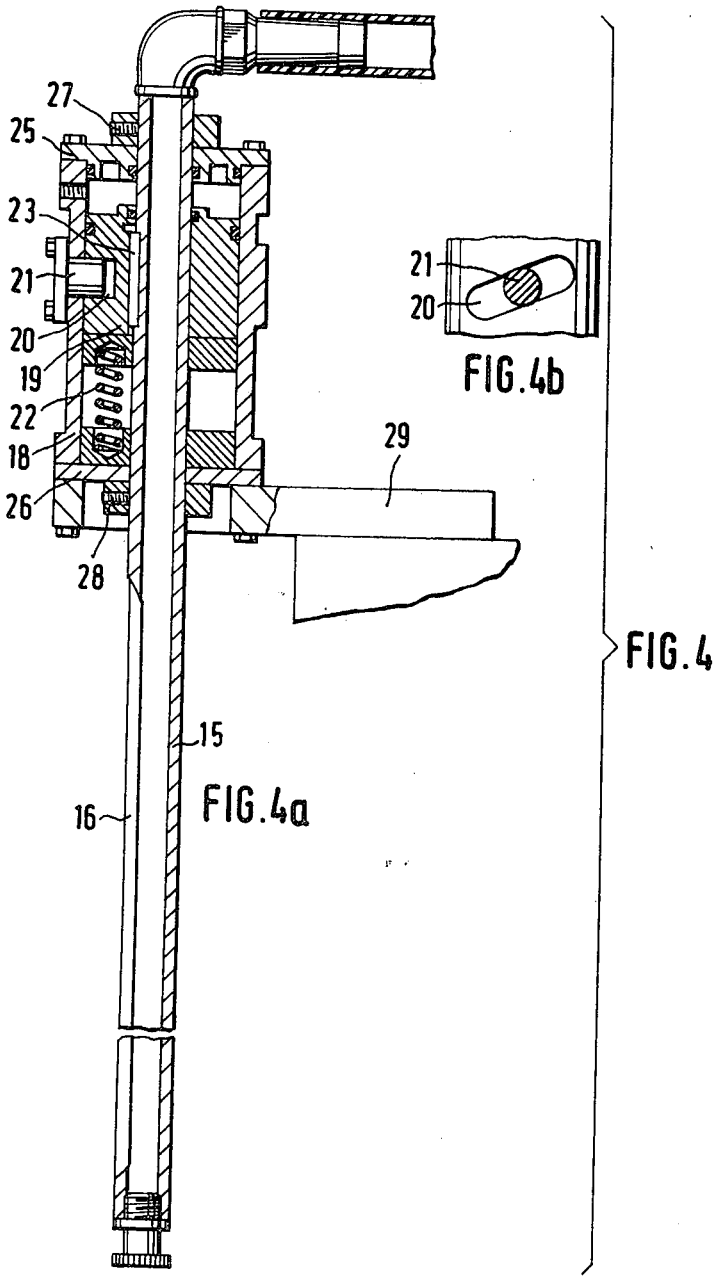
FIG. 4 is an axial section through the glueing means of FIG. 5, taken along the line I—I.

For the swinging movement of the tube 15 together with the glue scraper 17, a common servomotor in the form of a cylinder-piston arrangement is provided. (FIG. 4.) Said cylinder-piston arrangement consists of a stationary cylinder housing 18 and a single-acting piston 19 which over a portion of its circumference has an obliquely extending groove 20 which is engaged by a pin 21, as shown in detail in the fragmentary view on the right-hand side in FIG. 4. When pressure is applied to the top of the piston 19, the latter is not only axially displaced in the housing 18 against the force of springs 22 but, because of the obliquely extending groove 20 and the pin 21 which engages it, also rotated. The tube 15, which through a spline 23 is nonrotatably coupled to the piston 19 while being capable of axial displacement relative thereto, participates in that rotary motion. The tube 15 is secured against axial displacement by means of locking members 27 and 28 which abut on the covers 25 and 26 of the housing 18. A doctor blade 30 adapted to be positioned radially with respect to the glue roll 8 is fastened to a frame 29 to which also the cylinder housing 18 is bolted. The doctor blade 30 is adjusted for the desired thickness of the glue layer and remains so adjusted both in idling (no bottle feed) and in normal operation. Disposed at the lower end of the glue roll 8 is a further scraper 32 which keeps that end free of glue. A basin 31 in which surplus glue collects is located beneath the glueing means. That glue is again fed to the applicator means 15 and 16.

When there is no break in the sequence of bottles, the applicator means 15 and 16 is in the position shown in FIG. 5. In this position, the glue is applied in excess as a sheetlike jet directly to the glue-roll surface. The doctor blade 30, set for a particular glue-layer thickness (for example, spaced 0.05 mm from the glue-roll surface), dispenses the glue in such a way that the glueing segments 10 which roll along the surface of the glue roll are able to pick up sufficient glue. As soon as the sensor 3 detects a gap in the row of bottles, a hydraulic fluid is caused to act on the piston 19, with the result that the tube 15 is rotated into the position shown in FIG. 3, in which the glue jet which continues to exit is directed into the basin 31 rather than onto the glue-roll surface.

The oblique position of the elongated slot 16 provides an effective break-away edge on the glue-roll side which prevents the dripping of even minor amounts of glue onto the glue-roll surface. Moreover, there is no fouling with glue flung off the glue-roll surface since the glue feed to the glue roll 8 is stopped and the glue already on the glue-roll surface is removed by means of the glue scraper 17. Encrustations of the glue-roll surface with glue therefore are eliminated. In addition, the glue roll 8, scraped dry, also removes the glue from the glueing segments 10 so that no additional elements are required for that function.

We claim:

1. In a labeling station for bottles or the like having at least one glue segment which is rotatably mounted on a revolving carrier and having a pickup surface, a label magazine, a rotating glue roll which coats the pickup surface with glue such that labels can be picked up thereby from the label magazine, a rotating gripper cylinder which picks up labels from the segments and then affixes the label by its glue-coated side to a bottle moving past it and applicator means for applying a layer of glue to the surface of the glue roll including a doctor blade for determining the thickness of the layer by its spacing from the glue-roll surface, the improvement wherein the applicator means further comprises means defining a glue nozzle for producing a glue jet, a glue scraper and means mounting the glue nozzle means and the glue scraper for swinging movement about an axis parallel to that of the glue roll from a first position where the glue jet is directed at the surface of the glue roll and the scraper is spaced apart from the glue roll surface to a second position where the glue jet is directed away from the glue roll surface and the scraper is ahead of the doctor blade in the direction of rotation of the glue roll and is closer to the surface of glue roll than the doctor blade to remove any glue thereon.

2. A labeling station according to claim 1, wherein the glue nozzle means forms a slot nozzle.

3. A labeling station according to claim 1, wherein the glue nozzle means comprises a tube having an elongated slot forming a slot nozzle.

4. A labeling station according to claim 3, wherein the tube is parallel to the glue roll axis and the slot nozzle is disposed obliquely in the wall of the tube to provide a sharp break-away edge.

5. A labeling station according to claim 1, wherein the glue scraper bears on the glue roll surface tangentially under tension in the second position.

6. A labeling station according to claim 5, wherein the glue scraper comprises material having spring resilience.

7. A labeling station according to claim 1, wherein the mounting means comprises a common actuating drive for the glue nozzle means and the glue scraper.

8. A labeling station according to claim 7, wherein the actuating drive comprises a cylinder-piston construction including a rotatable piston, a stationary cylinder housing and a steep-pitch thread coupling the piston and cylinder and wherein the nozzle means and scraper are connected to the piston for rotation therewith.

9. A labeling station according to claim 1, wherein the glue roll comprises a wear-resistant cylinder and support members supporting the cylinder for yielding in the radial direction.

10. A labeling station according to claim 9, wherein the glue roll cylinder comprises a shape-retaining material.

11. A labeling station according to claim 10, wherein the glue roll cylinder comprises an essentially rigid material.

12. A labeling station according to claim 11, wherein the glue roll cylinder comprises sheet steel.

13. A labeling station according to claim 9, wherein the glue roll further comprises a sleeve which is rotatably driven and wherein the support members comprise resilient material and are mounted on the sleeve.

14. A labeling station according to claim 13, wherein the support members are rings and are axially spaced from one another.

* * * * *